US007386959B2

(12) United States Patent
Ouellette

(10) Patent No.: US 7,386,959 B2
(45) Date of Patent: Jun. 17, 2008

(54) SNAP-FIT WINDOW

(75) Inventor: Francois Ouellette, Quebec (CA)

(73) Assignee: Industries Cover Inc. (CA)

( * ) Notice: Subject to any disclaimer, the term of this patent is extended or adjusted under 35 U.S.C. 154(b) by 360 days.

(21) Appl. No.: 10/884,944

(22) Filed: Jul. 7, 2004

(65) Prior Publication Data

US 2006/0005481 A1 Jan. 12, 2006

(51) Int. Cl.
*E06B 3/30* (2006.01)
*B65D 63/06* (2006.01)
*B65D 63/08* (2006.01)

(52) U.S. Cl. ..... 52/204.53; 24/294; 24/295

(58) Field of Classification Search ..... 52/204.53, 52/211, 171.1, 204.54, 212; 49/505; 220/4.21, 220/4.22, 4.23, 4.24; 24/294, 295, 297; 403/329, 403/397

See application file for complete search history.

(56) References Cited

U.S. PATENT DOCUMENTS 3,527,011 A * 9/1970 Bloom et al. ..... 52/204.593
3,750,358 A * 8/1973 Lewkowitz ..... 52/204.597
3,818,669 A * 6/1974 Moss ..... 52/584.1
4,021,967 A 5/1977 Mulder et al.
4,194,336 A * 3/1980 Weinar ..... 52/481.1
4,407,100 A 10/1983 Huelsekopf
5,018,330 A * 5/1991 Lewkowitz ..... 52/455
5,040,347 A 8/1991 Valvis
5,133,168 A 7/1992 Neilly
5,189,862 A * 3/1993 Lafleur ..... 52/771
5,379,518 A * 1/1995 Hopper ..... 29/897.312
5,577,355 A 11/1996 Leonelli et al.
6,151,849 A * 11/2000 Twigg et al. ..... 52/208
6,272,801 B1 * 8/2001 Suh ..... 52/211
6,553,735 B1 4/2003 Wang Chen
6,830,280 B2 * 12/2004 Sturt et al. ..... 296/97.9
6,922,946 B2 * 8/2005 Gerard ..... 49/505
2003/0041539 A1 * 3/2003 Bernacki et al. ..... 52/204.54

* cited by examiner

*Primary Examiner*—Brian Glessner
*Assistant Examiner*—Adriana Figueroa
(74) *Attorney, Agent, or Firm*—Nixon & Vanderhye PC

(57) ABSTRACT

A frame assembly comprised of a pair of frame halves each having an axially extending attachment rib is temporarily secured for storage and transport by detachably clipping the attachment ribs together. The frame halves are disengaged, rotated, and lockingly clipped together for final installation.

17 Claims, 5 Drawing Sheets

SNAP-FIT WINDOW

BACKGROUND OF THE INVENTION

The present invention relates to a frame assembly, such as a window frame assembly, including clip(s) for temporarily securing the frames of the assembly for storage and transport and for locking the frames of the assembly upon installation.

Fixed frame window assemblies such as so-called door lights are typically manufactured at a manufacturing facility and then shipped for ultimate installation at another location. Referring to FIG. 1, a typical fixed frame window assembly 10 includes an insulated glass panel 12 and a pair of frame halves 14, 16 that sandwich the glass panel and support it in a corresponding opening defined e.g., through a door or wall. The glass panel is typically comprised of a pair of transparent panes sealed to a spacer frame.

It is desirable to secure the frame halves to capture the glass panel therebetween during transportation to protect the glass panel from damage, and to ensure that the delivered unit is complete. At the time of installation, screws 20 are threaded through aligned bosses 22, 24 of the frame halves to mount the frame assembly to the door with the glass panel captured therebetween.

Although the frame halves can be secured for transport using the mounting screws 20, such a process would be labor intensive, requiring additional man hours to secure the frame halves with screws for transport and to detach the frame halves for assembly to the door or other structure. Also, the conventional screw boss assembly of the type illustrated in FIG. 1 has the disadvantage that the final product has visible screw heads which may need to be capped for aesthetic reasons and which, even if capped, may detract from the aesthetics of the final product.

BRIEF DESCRIPTION OF THE INVENTION

The present invention provides an attachment structure in the form of one or more clips to temporarily secure the frame halves during transport and to effectively permanently secure the halves during final installation. By providing a clip for final installation, additional fasteners such as screws may be omitted, thereby simplifying and expediting the final assembly process.

Thus, the invention may be embodied in a frame assembly comprising: a pair of frame halves, each including an inner frame portion, an outer frame portion, and an axially extending attachment rib aligned with the attachment rib of the other frame half and terminating in a free edge remote from said inner and outer frame portions; a plurality of spaced locking ribs, each said locking rib extending along a portion of the attachment rib of one of said frame halves, substantially in parallel to said free edge of said attachment rib and remote from said inner and outer frame portions thereof; and a clip structure projecting axially from the attachment rib of the other of said frame halves and engaging one of said locking ribs of the one of said frame halves to secure said frame halves together.

The invention may also be embodied in a method for securing a frame assembly, comprising: providing a frame assembly comprising a pair of frame halves, each including an inner frame portion, an outer frame portion, and an axially extending attachment rib aligned with the attachment rib of the other frame half and each terminating in a free edge remote from said inner and outer frame portions; a plurality of spaced locking ribs, each said locking rib extending along a portion of the attachment rib of one of said frame halves, substantially in parallel to said free edge of said attachment rib and remote from said inner and outer frame portions thereof; providing a clip structure to project axially from the attachment rib of the other of said frame halves; and engaging said clip structure with the attachment rib of the one of said frame halves to secure said frame halves together.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
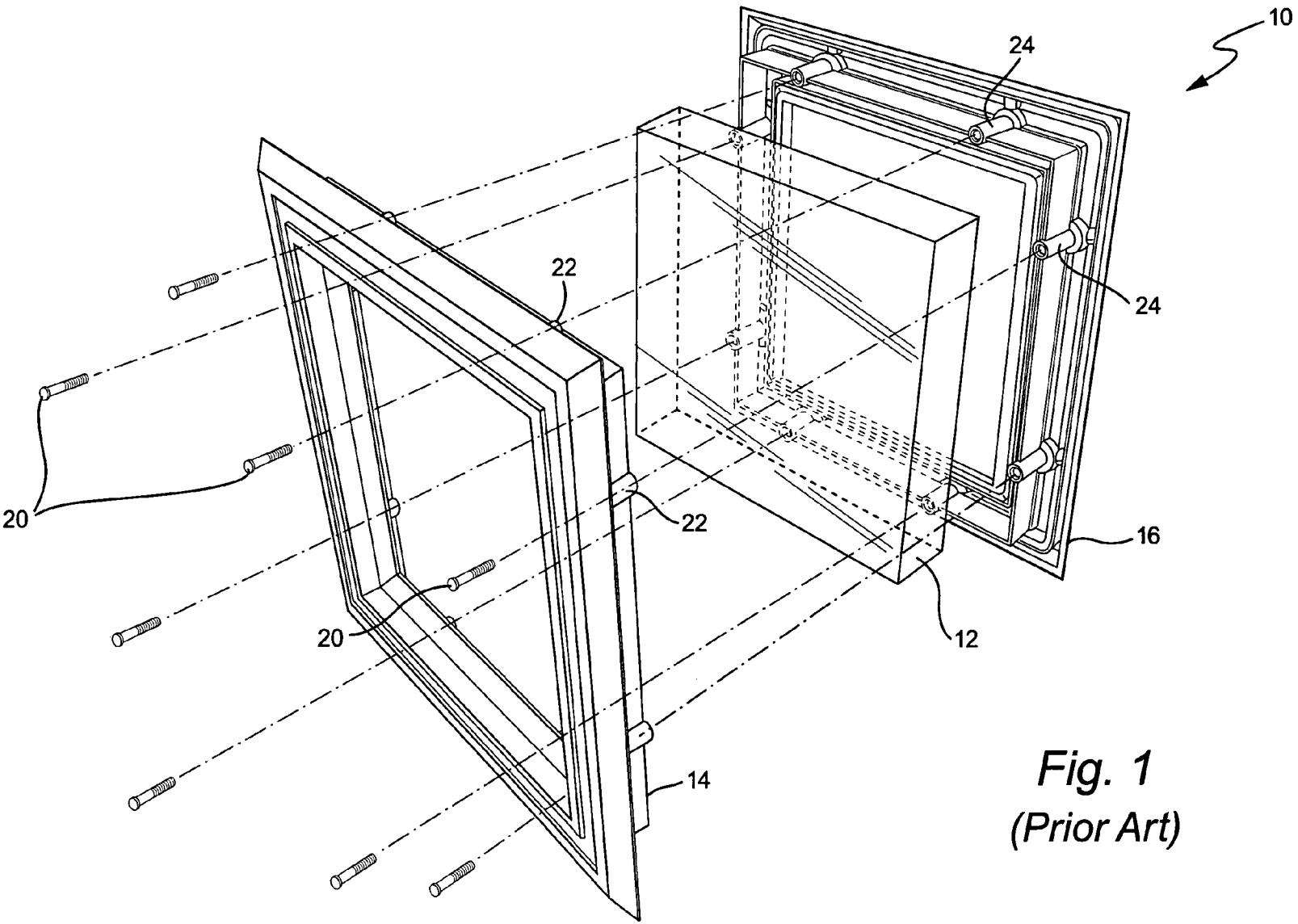
Fig. 1 (Prior Art)
FIG. 1 is a perspective view illustrating a prior art window frame assembly.

As mentioned above with reference to FIG. 1, conventionally, a fixed frame assembly is comprised of first and second frame halves that are configured to capture a glass panel therebetween. As illustrated, the frame halves may be secured by screws threaded through respectively axially aligned bosses of the frame halves. In an embodiment of the invention, to temporarily secure the frame halves for storage and transport and to effectively permanently secure the frame halves on installation, a plurality of spaced locking ribs have been provided to extend along discrete segments of the attachment rib of each frame half and clip structure(s) are provided to project from one frame half to selectively lockingly engage the locking rib of the axially opposed frame half.

Figure 2:
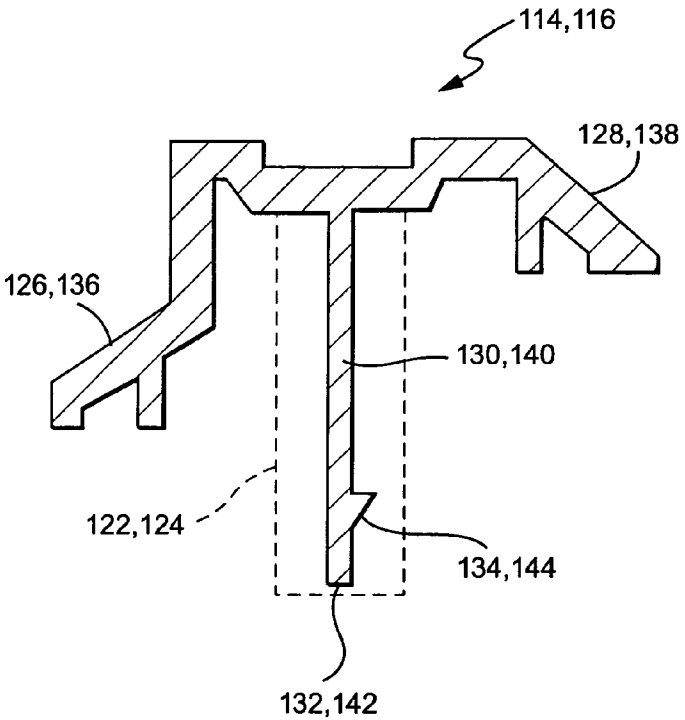
FIG. 2 is a schematic cross-sectional view of a frame half embodying the invention.
Figure 5:
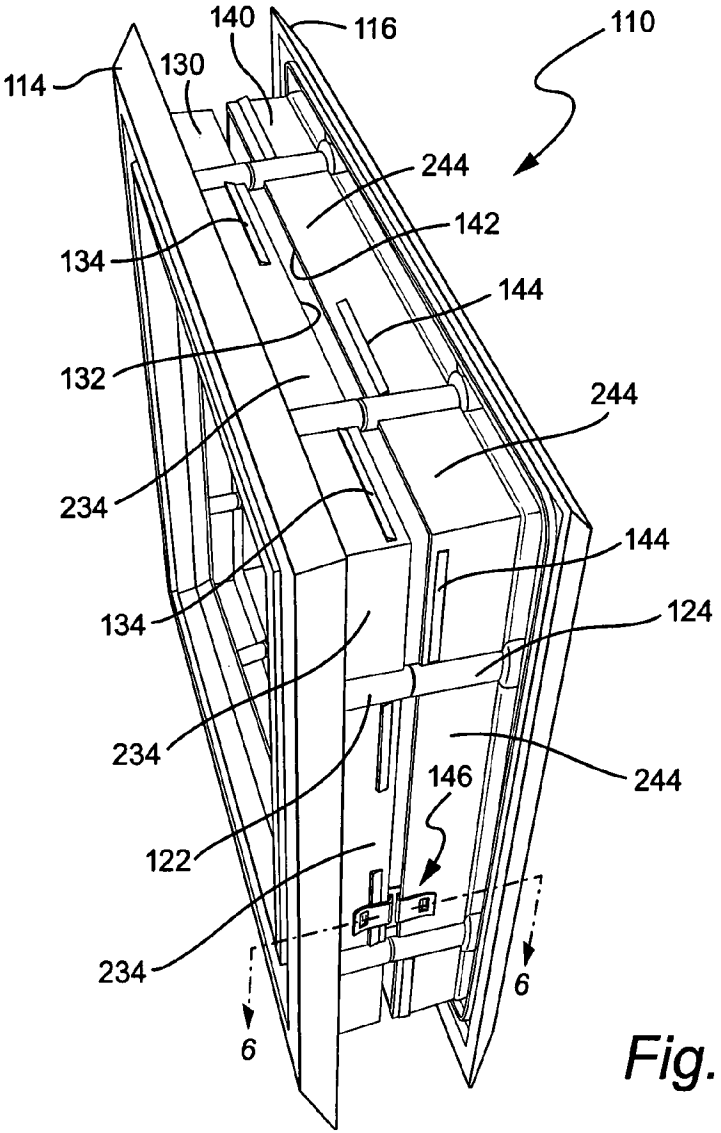
FIG. 5 is a schematic perspective view of a frame assembly secured for storage and/or transport in an embodiment of the invention.

Thus, referring to FIGS. 2 and 5, in an embodiment of the invention, a frame assembly is provided that is comprised of a pair of frame halves 114, 116, each including an inner frame portion 126, 136 an outer frame portion 128, 138 and an axially extending attachment rib 130 axially aligned with the attachment rib 140 of the other frame half 116 and terminating in a free edge 132, 142 remote from said inner and outer frame portions. A panel 112, such as an insulated glass panel, is supported by and between the inner frame portions 126, 136 of the pair of frame halves 114, 116. Locking ribs 134, 144 are provided to extend along a portion of the attachment rib of at least one of the frame halves, substantially in parallel to the free edge 132, 142 of the attachment rib and remote from the inner and outer frame portions. Further, a clip structure 146 projects axially from the attachment rib of one of the frame halves to selectively engage one of the locking ribs of the other of the frame halves to secure the frame halves together with the panel therebetween.

Conventional screw bosses 122, 124 may be provided to extend in the axial direction of the attachment ribs 130, 140 in a conventional manner and thus are illustrated in FIG. 5 and in phantom in FIG. 2. As will be appreciated, however, the snap attachment provided by the clip structure 146 of the invention may eliminate the need for screw threaded attachment of the frame halves, so that these bosses 122, 124 may be omitted if deemed necessary or desirable. In the alternative, a screw may be threaded through one or more of the pairs of axially aligned bosses to augment the security with which the frame assembly is mounted.

As mentioned above, to secure the frame halves with respect to each other, clip structure 146 is provided to project from one of the frame halves 114 and includes a receptacle 150 for engaging the attachment rib 140 of the opposing frame half 116. In the illustrated embodiment, the clip structure is a separately formed component that is lockingly engaged with the locking rib 134 of one frame half 114 to project axially therefrom. In the illustrated embodiment, the locking clip is axially symmetrical with respect to its centerline. Thus, the locking clip includes first and second receptacles 148, 150 that are generally U-shaped in cross-section for respectively receiving the attachment ribs of the respective frame halves. Locking tabs 152, 154 are provided for lockingly engaging a locking rib of the respective attachment rib. In an exemplary embodiment, the free ends of the legs 156, 158, 160, 162 of the "U-shaped" receptacles 148, 150 are respectively flared to facilitate alignment and mounting to the respective attachment rib, particularly during final assembly through the hole in the door slab or the like.

Figure 4:
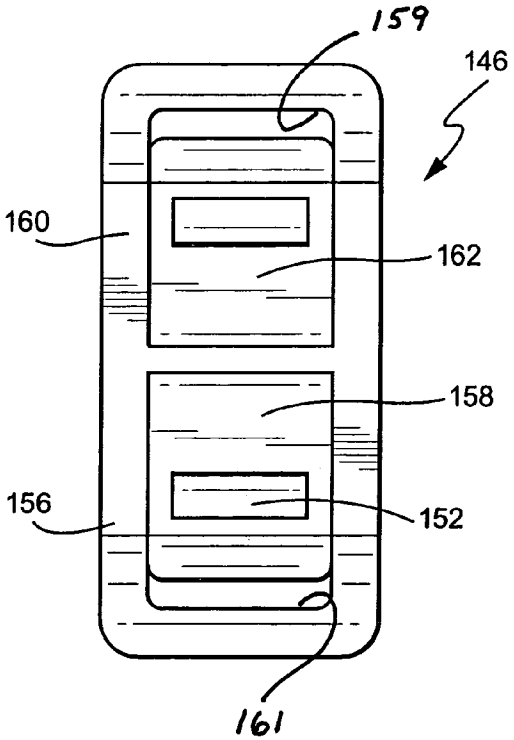
FIG. 4 is a front elevational view of the clip of FIG. 3.
Figure 3:
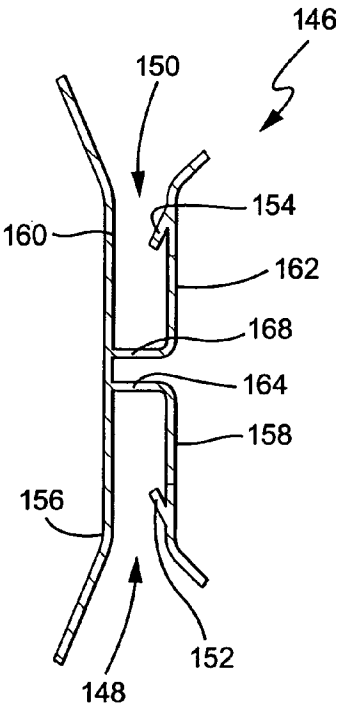
FIG. 3 is a side elevational view of a locking clip embodying the invention.

In the illustrated embodiment, the locking clip is formed by stamping a metal plate, so that one of the legs 156, 160 of each U-shaped receptacle is effectively a frame of material surrounding an opening 159, 160 from which the other leg 158, 162 has been stamped and then laterally offset by base segment 164, 166, as shown and understood from FIGS. 3 and 4. Locking tabs 152, 154 are formed as well, e.g. during the stamping and forming process, and may be generally rectangular in form as illustrated or formed as spaced triangular prongs. Although the locking clip is in an exemplary embodiment formed from metal, it is to be appreciated that as an alternative, a molded, plastic clip could be provided with departing from the invention.

In the illustrated embodiment the clip is provided as a separate component that receives and engages the attachment rib of each frame half in a respective receptacle. However, as an alternative, a clip structure may be provided to integrally project from the attachment rib of one of the frame halves to define a receptacle for receiving the other of the frame halves. It is also to be appreciated that although the clip structure is illustrated as defining a locking tab for engaging a locking rib on an attachment rib of the frame half, the so-called locking rib may be configured as a cavity having a surface for the tab of the clip to engage. Accordingly, locking rib as used herein may be construed as a protrusion on the attachment rib or a recess or cavity on the attachment rib. Similarly, the so-called locking tab(s) of the clip structure may be defined as a protrusion or a recess or cavity, provided that the locking rib and locking tab are configured in a complementary manner so that the locking tab of the clip can slide to or past the locking rib and the locking tab and locking rib can engage to lock the clip structure to the attachment rib.

Figure 6:
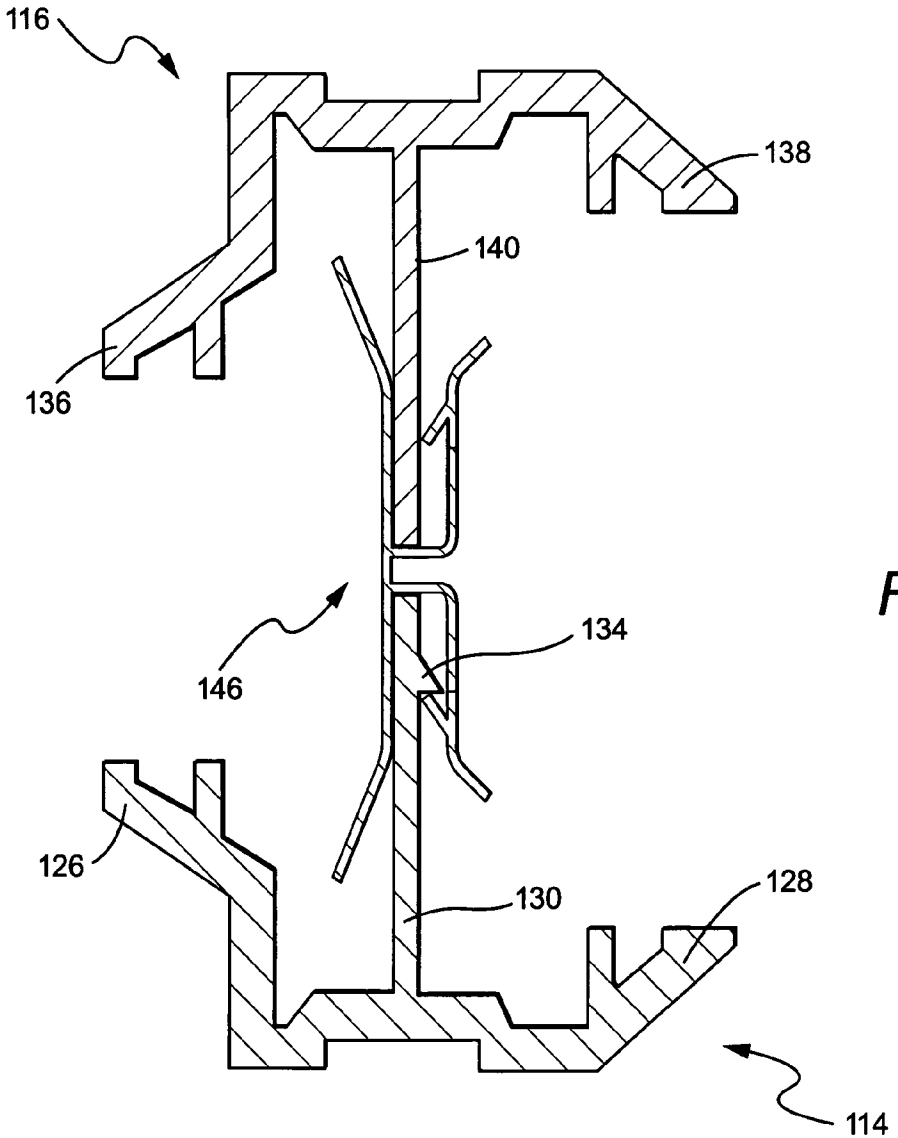
FIG. 6 is a schematic cross sectional view taken along line 6-6 of FIG. 5.

Referring to FIGS. 5 and 6, in an exemplary embodiment, the frame assembly 110 is shaped as a polygon having a plurality of diametrically opposed straight sides. For ease of illustration, a particularly small frame is shown. It is to be appreciated, however, that the panel and frame assembly may be substantially larger than the illustrated structure and/or may have a shape differing from that shown. To provide for a temporary attachment of the frame halves during storage and transport and an effectively permanent attachment on installation, in an embodiment of the invention the locking ribs are disposed asymmetrically with respect to one another on the diametrically opposite straight sides of each frame half and the two frame halves are substantially identical. Thus, as will be appreciated from FIG. 5, in the storage/transport orientation of the frame halves, each discrete locking rib 134, 144 is disposed so as to correspond to a locking rib-free portion 234, 244 of the axially facing frame half. In this configuration, as illustrated in FIG. 6, the locking clip 146 is lockingly engaged with the locking rib 134 of one frame half 114 but receives a locking rib-free portion 244 of the axially aligned attachment rib 140 of the other frame half 116. As such, the locking clip 146 is locked to one frame half 114 and secured, but not locked, to the other frame half 116.

Figure 7:
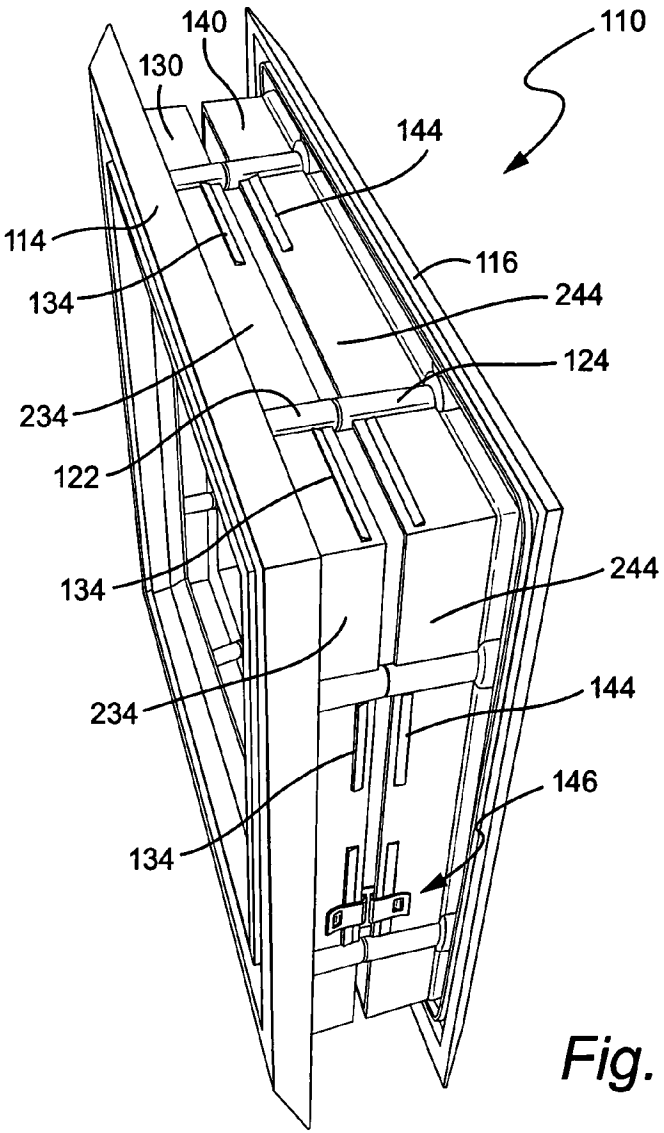
FIG. 7 is a schematic perspective view similar to FIG. 5 showing the frame halves axially aligned and clipped.
Figure 8:
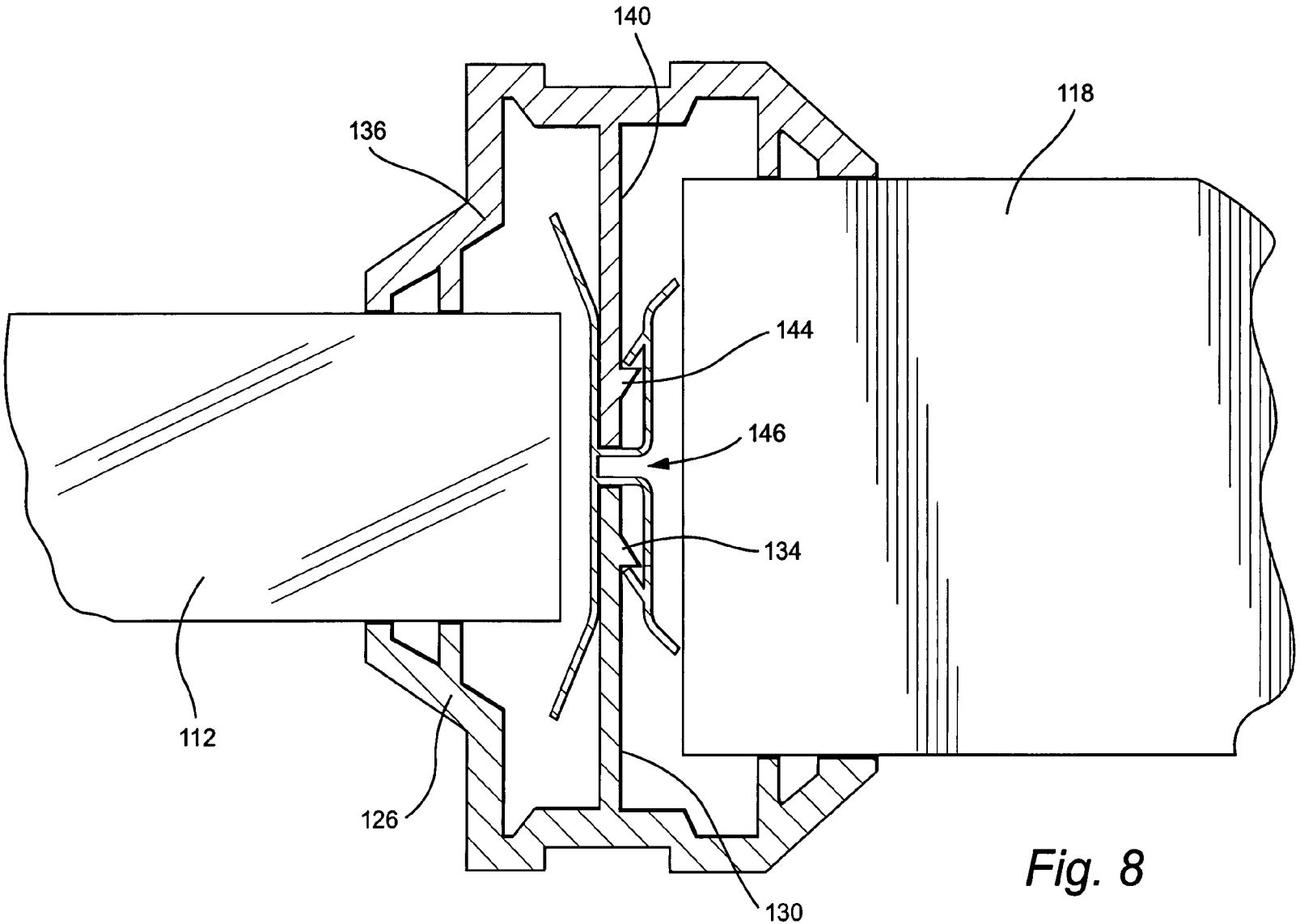
FIG. 8 is a view taken along line 8-8 of FIG. 7 and also illustrating the glass panel and door slab to which the frame assembly is installed.

At the time of final installation, when it is desired to effectively permanently attach the frame halves, the detachably secured frame half 116 is axially shifted to disengage from the clip 146 and is rotated, e.g., by 180 degrees to the position shown in FIG. 7, so that the diametrically opposite side thereof is now aligned with the respective side of the first frame. Because the diametrically opposite side of the second frame 116 has locking ribs 144 that axially align with the locking ribs 134 of the first frame 114, if the second frame half is then axially displaced towards the first frame half, the attachment rib 144 will be received in the receptacle 150 of the clip and the clip will lockingly engage the locking rib as illustrated in FIGS. 7 and 8. To effectively and securely hold the frame halves together, a plurality of clips 146 are provided about the periphery of the frame assembly. In the illustrated embodiment, each locking rib has an inclined surface and a straight locking surface to effectively displace the resilient locking tab(s) 152, 154 of the clip on insertion and to lockingly engage with the locking tab following insertion. It is to be understood that as an alternative, the locking ribs may be rectangular in cross-section, or may define a recess or cavity as mentioned above. Moreover, although the locking tabs are characterized as resilient hereinabove, as an alternative, the respective leg of the clip may deflect on engagement of the locking tab with a protruding locking rib, so that the tab can pass and engage the locking surface of the locking rib.

As can be seen and as will be understood, with the structure of the invention, respective halves 114, 116 of a fixed frame assembly 110 may be temporarily secured for storage and transport (FIGS. 5 and 6) and by detaching, rotating, e.g., 180 degrees, and re-engaging (FIGS. 7 and 8) can be permanently secured to support the glass panel or other central panel 112 in a hole defined through a structural slab 118, such as a door in the case of a door light or a wall or ceiling in the case of a window or sky-light. It will be appreciated that the frame rotation required between the transport and installation configurations will depend on the shape of the frame assembly and the symmetrical locking rib pattern provided. Thus, where the frame assembly has more than two axes of symmetry, e.g. if it is circular, hexagonal, or square, then the rotation angle can be 90 degrees or less, whereas if the frame assembly has only two axes of symmetry, e.g. if it is an oblong rectangle or elliptical, then the rotation angle will be 180 degrees.

In an exemplary embodiment, each locking rib has a dimension in the axial direction of the frame assembly of about 2 mm and is disposed so that the locking surface thereof is approximately 6.5 mm from the free edge of the attachment rib. Moreover, in an exemplary embodiment, the locking rib has a transverse height of approximately 1 mm. Finally, in an exemplary embodiment, each discrete locking rib has a length in a direction transverse to the axial direction of the frame of about 35 mm. It is to be appreciated that the dimensions given are by way of example only and are not to be considered limiting with respect to the disclosed invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A frame assembly comprising:

first and second frame halves, each including an inner frame portion, an outer frame portion, and an axially projecting attachment rib axially aligned with the attachment rib of the other frame half and terminating axially in a free edge remote from said inner and outer frame portions;

a plurality of spaced locking ribs, each said locking rib extending longitudinally along a portion of the attachment rib of the first frame half, substantially in parallel to said free edge of said attachment rib and remote from said inner and outer frame portions thereof; and a clip structure projecting axially from the attachment rib of the second frame half, said clip being separately formed from said frame halves and being secured to said second frame half, said clip defining first and second axially open U-shaped receptacles for axially receiving respectively said attachment rib of said first frame half and said attachment rib of said second frame half, thereby to secure said frame halves together in axially opposed, facing relation, wherein said clip is formed by stamping and forming a metal plate, wherein each of said U-shaped receptacles comprises first and second legs, said first leg comprising a frame of material surrounding an opening and said second leg being laterally offset by a base segment from and disposed in opposed facing relation to said opening.

2. A frame assembly as in claim 1, wherein said clip engages one of said locking ribs of the first frame half when said attachment rib of said first frame half is received in said first receptacle of said clip.

3. A frame assembly as in claim 1, wherein a plurality of spaced locking ribs are disposed on the attachment rib of each of said frame halves.

4. A frame assembly comprising:

first and second frame halves, each including an inner frame portion, an outer frame portion, and an axially projecting attachment rib axially aligned with the attachment rib of the other frame half and terminating axially in a free edge remote from said inner and outer frame portions;

a plurality of spaced locking ribs, each said locking rib extending longitudinally along a portion of the attachment rib of the first frame half, substantially in parallel to said free edge of said attachment rib and remote from said inner and outer frame portions thereof; and a clip structure projecting axially from the attachment rib of the second frame half, said clip being separately formed from said frame halves and being secured to said second frame half, said clip defining first and second axially open U-shaped receptacles for axially receiving respectively said attachment rib of said first frame half and said attachment rib of said second frame half, thereby to secure said frame halves together in axially opposed, facing relation, wherein a plurality of spaced locking ribs are disposed on the attachment rib of each of said frame halves, wherein said frame halves are polygonal, having a plurality of diametrically opposite straight sides, the locking ribs on one of said straight sides being laterally offset with respect to the locking ribs of said diametrically opposite side thereto, whereby if two said frame halves are axially opposed in a first position, the locking ribs are not axially aligned, and if said two frame halves are axially opposed in a second position that is 180 degrees rotated relative to said first position, said locking ribs are axially aligned, and wherein each of said U-shaped receptacles comprises first and second legs, said first leg comprising a frame of material surrounding an opening and said second leg being laterally offset by a base segment from and disposed in opposed facing relation to said opening.

5. A frame assembly as in claim 4, wherein said clip is axially symmetric such that first and second longitudinal ends thereof are mirror images of one another and said receptacles open in diametrically opposite directions.

6. A frame assembly as in claim 5, wherein said clip is formed by stamping and forming a metal plate.

7. A frame assembly as in claim 2, wherein said clip includes at least one locking tab for lockingly engaging said locking rib.

8. A frame assembly as in claim 7, wherein said locking rib is generally triangular in cross-section.

9. A frame assembly as in claim 1, further comprising a plurality of bosses disposed at spaced locations along each said attachment rib and extending axially in a direction perpendicular to the direction in which said locking ribs longitudinally extend.

10. A frame assembly as in claim 9, wherein each said boss includes a bore for receiving a screw.

11. A frame assembly as in claim 1, wherein said clip is axially symmetric such that first and second longitudinal ends thereof are mirror images of one another and said receptacles open in diametrically opposite directions.

12. A frame assembly as in claim 1, wherein said locking ribs protrude from a plane of said attachment rib.

13. A frame assembly as in claim 1, further comprising a panel supported by and between said inner frame portions of said pair of frame halves.

14. A frame assembly as in claim 13, wherein said panel comprises and insulated glass panel.

15. A frame assembly as in claim 4, wherein said clip is formed by stamping and forming a metal plate.

16. A frame assembly as in claim 7, wherein said at least one locking tab projects from said second leg towards said opening in said first leg.

17. A frame assembly as in claim 4, wherein said clip includes at least one locking tab for lockingly engaging said locking rib, and wherein said at least one locking tab projects from said second leg towards said opening in said first leg.

* * * * *